United States Patent [19]

Kirihara et al.

[11] 4,407,900

[45] Oct. 4, 1983

[54] ELECTROPLATED CORROSION RESISTANT STEELS AND METHOD FOR MANUFACTURING SAME

[75] Inventors: Shigeki Kirihara, Kobe; Masatoshi Iwai, Kakogawa, both of Japan

[73] Assignee: Kabushiki Kaisha Kobe Seiko Sho, Kobe, Japan

[21] Appl. No.: 309,782

[22] Filed: Oct. 8, 1981

[30] Foreign Application Priority Data

Oct. 17, 1980 [JP] Japan ..... 55-146019

[51] Int. Cl.[3] ..... C25D 5/10; B32B 15/18

[52] U.S. Cl. ..... 428/659; 204/41; 204/43 Z; 428/658

[58] Field of Search ..... 204/43 Z, 41, 40; 428/659, 658

[56] References Cited

U.S. PATENT DOCUMENTS

| | | | |
|---|---|---|---|
| 4,064,320 | 12/1977 | Adaniya et al. | 428/632 |
| 4,134,893 | 2/1982 | Clauss | 204/40 |
| 4,313,802 | 2/1982 | Shibuya et al. | 204/28 |

FOREIGN PATENT DOCUMENTS

| | | | |
|---|---|---|---|
| 19979 | 5/1974 | Japan . | |
| 20190 | 2/1981 | Japan | 204/43 Z |

*Primary Examiner*—G. L. Kaplan

*Attorney, Agent, or Firm*—Oblon, Fisher, Spivak, McClelland & Maier

[57] ABSTRACT

An electroplated corrosion resistant steel, having on a base steel a first plated layer of a Zn-Ni alloy containing 5–20% of Ni and a second electroplated layer of zinc containing 0.005–0.5% of Cr. A method for producing the high corrosion resistant steel material is also disclosed.

10 Claims, No Drawings

ELECTROPLATED CORROSION RESISTANT STEELS AND METHOD FOR MANUFACTURING SAME

BACKGROUND OF THE INVENTION (1) Field of the Invention

This invention relates to electroplated extremely high corrosion resistant steels and a method for producing same.

(2) Description of the Prior Art

The Zn-plating or galvanizing is widely resorted to in the art as means for imparting corrosion resistance to the surfaces of steel materials. In this connection, it is known that electrogalvanized steel plates are generally inferior to dip-plated steel plates in corrosion resistance due to the difficulty of forming zinc coatings of sufficient thickness by the electrogalvanizing process. Therefore, there have heretofore been made various attempts without increasing the metal deposition of the electrogalvanized steel plates to guarantee a higher corrosion resistance (e.g., Japanese Laid-Open Patent Specification No. 53-89835).

In the meantime, the present inventors developed a steel material with surfaces of high corrosion resistance, having an intermediate plated layer of a Zn-Ni alloy and an outer electrogalvanized layer on a base steel plate (Japanese Patent Application No. 54-113725, Kobe Steel Technical Report vol. 30, No. 1, pp. 64–67).

SUMMARY OF THE INVENTION

The present invention has as its object the provision of steel materials with surfaces of higher corrosion resistance and a method for manufacturing same.

According to the present invention, there is provided a steel material with surfaces of high corrosion resistance, the steel material having on a steel base a first plated layer of a Zn-Ni alloy containing 5–20% on Ni and a second electrogalvanized layer formed on the surface of the first layer and containing 0.005–0.5% of Cr.

According to the present invention, there is also provided a method for producing a steel material with a surface of high corrosion resistance, the method comprising: electroplating a base steel in a Zn-Ni alloy plating bath containing Zn and Ni respectively wherein each concentration of Zn and Ni in said plating bath is over 20 g/l respectively and in the range of 0.25–4 in a ratio of Zn concentration (g/l) to Ni concentration (g/l); and electroplating the steel material in an electrogalvanizing bath with 0.1–10 g/l of $Cr^{3+}$ content and/or 0.05–0.5 g/l of $Cr^{6+}$ content.

PATICULAR DESCRIPTION OF THE INVENTION

According to the surface treating method of the present invention, a plated Zn-Ni alloy is firstly formed on the base steel. The alloy plating which constitutes the first layer is known to have excellent corrosion resistance and shows especially high corrosion resistance when its Ni content is in the range of 5–20%. More specifically, there is a tendency that the corrosion resistance of the plated Zn-Ni alloy layer becomes insufficient with an Ni content less than 5% and decreases again when the Ni content exceeds 20%.

Subsequent to the formation of the first plated layer of the Zn-Ni alloy, a second electrogalvanized layer containing 0.005–0.5% of Cr is formed thereon. The reason why the second layer is formed by electrogalvanizing is that the first layer of the Zn-Ni alloy plating is unsuitable for the treatment with a phosphate or chromate which is usually adopted as an after-treatment.

In the present invention, the second or outer electrogalvanized layer contains 0.005–0.5% of Cr to guarantee a higher corrosion resistance. If the Cr content is less than 0.005%, the corrosion resistance becomes no more than that of pure Zn plating. On the other hand, if it exceeds 0.5%, the plated layer becomes brittle and inferior in adhesion and appearance.

In order to impart a maximum corrosion resistance in the surface treatment according to the present invention, it is desired to form the respective plated layers in appropriate thicknesses. More specifically, the thickness of the first plated layer of the Zn-Ni alloy is preferred to be more than about 1/20 of the total thickness of the coating layers from the standpoint of maintaining a high corrosion resistance, while the second or outer electrogalvanized layer is preferred to have a thickness greater than about 1 $g/m^2$ in consideration of the treatment with a phosphate or chromate in the subsequent stage.

According to the present invention, the steel material is subjected to a surface treatment in the manner as described hereafter.

After degreasing and pickling a steel plate in the usual manner, the first layer of the Zn-Ni alloy is electroplated thereon. For the Zn-Ni alloy plating bath, it is preferred to use an acid bath like a sulfate bath or chloride bath which is low in cost and capable of producing high current density. The Zn and Ni concentrations in the plating bath should be greater than 20 g/l respectively for the following reasons. If the Zn concentration is smaller than 20 g/l, there occurs burnt deposit at a current density higher than 10 $A/dm^2$. On the other hand, a Ni concentration less than 20 g/l results in a plated layer which has a Ni content falling below an appropriate range. In addition, it is necessary that the ratio of the Zn concentration to Ni in the plating bath, [Zn concentration (g/l)]/[Ni concentration (g/l)], be in the range of 0.25–4. This is because a concentration ratio smaller than 0.25 will results in a plated layer with a Ni content greater than 20 wt %, which is inferior in corrosion resistance. On the contrary, with a concentration ratio in excess of 4, the Ni content in the plated layer falls short of an appropriate range.

The above-mentioned Zn-Ni alloy plating bath is preferred to have a pH in the range of 1.5–3.5, since a pH over 3.5 will deteriorate the adhesion of the plated metal film due to increase internal stress of the film and a pH below 1.5 will increase the number of pits in the plated film and cause considerable corrosion to the piping of the plating bath and the like. Besides, the Zn-Ni alloy plating bath is preferred to have a temperature in the range of 40° C.–70° C., preferably in the range of 50° C.–60° C., because a temperature below 40° C. tends to cause burnt deposit at a high current density and a temperature over 70° C. will result in a Ni content in excess of the appropriate range and cause accelerated evaporation of the plating bath, which is a great disadvantage to the operation.

The current density is desired to be as high as possible from the standpoint of productivity, but electroplating of the Zn-Ni alloy with an almost constant Ni content is feasible in a wide range of current density of from 5–40 $a/dm^2$ by stirring the bath during the plating operation.

Further, it is preferred to use simultaneously a zinc electrode and a nickel electrode for the cathode, adjusting the ratio of the zinc electrode to the nickel electrode such that the Zn and Ni concentrations in the plating bath are maintained constant.

The steel plate which has been plated with the first layer of the Zn-Ni alloy by the above-described procedures is subjected to a second electroplating bath for electrodepositing the second Cr-containing zinc layer after washing the steel plate with water to prevent the liquid of the Zn-Ni alloy plating bath from being brought into the Cr-containing electrogalvanizing bath. The plating of Cr-containing zinc is feasible by adding a soluble trivalent or hexavalent chromium compound to an ordinary electrogalvanizing bath. The amount of the chromium compound to be added to the plating bath should be in the range of 0.1–10 g/l in the case of a trivalent chromium compound and in the range of 0.05–0.5 g/l in the case of a hexavalent chromium compound to obtain a plated layer with a Cr content of 0.005–0.5 wt %. For example, the additive trivalent or hexavalent chromium compound is preferably selected from chromium sulfate ($Cr_2(SO_4)_3$), chromium chloride ($CrCl_3$), chromic acid anhydride ($CrO_3$) and the like in consideration of the solubility into the plating bath and the cost of the chemical. If desired, the trivalent and hexavalent chromium compounds may be added jointly.

The electrogalvanizing bath is preferred to have a pH in the range of 2.5–3.5 when a trivalent chromium is added and a pH in the range of 3.5–4.5 when a hexavalent chromium is added. It is also preferred that the electrogalvanizing bath is maintained in the same temperature range as that of the above-mentioned Zn-Ni alloy plating bath.

The steel plate which has been coated with the second Cr-containing zinc layer is washed with water and dried. Thereafter, the electrogalvanized layer of the steel plate is treated with a chromate or phosphate to improve further the corrosion resistance of the plate as well as the adhesion strength of paint film in the subsequent paint coating operation.

The invention is illustrated more particularly by the following Examples.

EXAMPLE 1

The first layer of the Zn-Ni alloy was plated after electrolytic degreasing and pickling a cold-rolled steel plate in the usual manner, under the conditions given below.

| | |
|---|---|
| Composition of plating bath | Zinc sulfate ($ZnSO_4$ $7H_2O$) . . . 200 g/l<br>Nickel sulfate ($NiSO_4$ $6H_2O$) . . . 200 g/l<br>Nickel chloride ($Nicl_2$ $6H_2O$) . . . 90 g/l |
| pH of plating bath | 3.0 |
| Temperature of plating bath | 60° C. |
| Current density | 30 A/dm$^2$ |

-continued

| | |
|---|---|
| Anode | Using both zinc and nickel with a surface ratio of zinc to nickel = 3:1 |

The metal deposition was controlled by way of the conducting current. The Ni content in the resulting plated layer was about 11 wt %.

Upon finishing the plating of the first layer, the steel plate was washed with water and immediately subjected to the plating of the second Cr-containing zinc layer, under the following conditions.

| | |
|---|---|
| Composition of plating bath | Zinc sulfate ($ZnSO_4$ $7H_2O$) . . . 400 g/l<br>Ammonium sulfate ($(NH_4)_2SO_4$) . . . 30 g/l<br>Chromium chloride ($CrCl_3$ $6H_2O$) . . . 20 g/l |
| pH of plating bath | 3.0 |
| Temperature of plating bath | 50° C. |
| Current density | 30 A/dm$^2$ |

The metal deposition was controlled by way of the conducted current. The Cr content in the resulting plated layer was about 0.02 wt %. The steel plate coated with the second layer was washed with water and dried.

A number of specimens were prepared according to the above-described procedures, holding the total metal deposition of the first and second layers constantly at 20 g/m but varying the ratio of metal deposition of the first layer to the second layer, subjecting the specimens to the salt spray test (JIS Z 2371). Table 1 shows the amounts of the metal depositions of the first and second layers of the respective specimens in relation with the rate of the surface areas which produced red rust 96 hours after the salt spray test. As seen therefrom, the Examples of the present invention showed excellent corrosion resistance in contrast to the pure zinc plating of Comparative Example No. 1 and the Cr-containing zinc plating of Comparative Example No. 2.

Then, the specimens of Table 1 were treated with a chromate (the chemical used: Zinchrom 357 made by Nihon Parkerizing Co., Ltd.), examining the effect of the treatment on the respective specimens.

The amounts of chromium depositions on the respective specimens are shown in Table 1. It will be seen that the Examples of the present invention permit the chromium deposition in a greater amount as compared with the Zn-Ni alloy plating of Comparative Example No. 3, exhibiting a higher effect of the chromate treatment.

The specimens of Table 1 were also treated with a phosphate (the chemical used: Bonderite 3312 made by Nihon Parkerizing Co., Ltd.) to examine the effect of the treatment. The amounts of the phosphate depositions on the respective specimens are shown also in Table 1. Similarly to the chromate treatment, the Examples of the present invention exhibited higher effect of the phosphate treatment, permitting the deposition of the phosphate in a greater amount than the Zn-Ni alloy plating.

TABLE 1

| Example Nos. | Arrangement of Plated layer(s): Deposition of Ni—Zn alloy in plate 1st layer ($g/m^2$) | Deposition Cr-containing zinc in plated 2nd layer ($g/m^2$) | Rate of Surface Area w/Red Rust 96 hrs. after salt spray test (%) | Chromium Deposition by chromate treatment ($mg/m^2$) | Phosphate Deposition by phosphat treatment ($mg/m^2$) |
|---|---|---|---|---|---|
| Invention | | | | | |
| 1 | 1 | 19 | 30% | 21 | 1.5 |
| 2 | 2 | 18 | 10% | 18 | 1.5 |
| 3 | 5 | 15 | 1% | 24 | 1.5 |
| 4 | 10 | 10 | 0% | 20 | 1.6 |
| 5 | 15 | 5 | 0% | 15 | 1.6 |
| 6 | 18 | 2 | 0% | 14 | 1.5 |
| 7 | 19 | 1 | 0% | 12 | 1.3 |
| Comparative | | | | | |
| 1 | Pure zn plating alone (20 $g/m^2$) | | 80% | 22 | 1.7 |
| 2 | Cr-containing zn plating alone (20 $g/m^2$) | | 50% | 18 | 1.7 |
| 3 | Zn—Ni alloy plating alone (20 $g/m^2$) | | 0% | 4 | 0.3 |

EXAMPLE 2

After electrolytically degreasing and pickling a cold-rolled steel plate in an ordinary manner, the first layer of the Zn-Ni alloy was plated thereon by the same method as in Example 1. The Ni content in the plated first layer was about 11 wt %.

The steel plate with the first coated layer was washed with water before plating the second Cr-containing zinc layer under the following conditions.

| | |
|---|---|
| Composition of plating bath | Zinc sulfate ($ZnSO_4$ $7H_2O$) . . . 400 g/l<br>Ammonium sulfate ($(NH_4)_2SO_4$) . . . 30 g/l)<br>Chromic acid anhydride ($CrO_3$) . . . 02 g/l) |
| pH of plating bath | 4.0 |
| Temperature of plating bath | 50° C. |
| Current density | 30 $A/dm^2$ |

The Cr content in the second zinc layer was about 0.15 wt %. The steel plate coated with the second Cr-containing zinc layer was washed with water and dried prior to the salt spray test.

The specimens with metal depositions of 10 $g/m^2$ in the first and second layers was free of red rust 96 hours after the salt spray test, exhibiting satisfactory corrosion resistance.

What is claimed is:

1. A steel material with a treated high corrosion resistant surface, comprising on a base steel a first plated layer of a Zn-Ni alloy consisting essentially of 5–20% of Ni and the balance Zn; and a second electroplated layer consisting essentially of zinc containing 0.005–0.5% of Cr.

2. A steel material as defined in claim 1, wherein said first plated layer of the Zn-Ni alloy has a thickness greater than 1/20 of the total thickness of the two plated layers.

3. A steel material as defined in claim 1, wherein said second electroplated layer of Cr-containing zinc has a thickness greater than about 1 $g/m^2$.

4. A method for producing a steel material with a treated high corrosion resistant surface, comprising electroplating on said steel material a first layer of a Zn-Ni alloy consisting essentially of Zn and Ni in a first plating bath containing Zn and Ni wherein each concentration of Zn and Ni in said plating bath is over 20 g/l, respectively, and having a ratio of Zn concentration (g/l) to Ni concentration (g/l) in the range of 0.25–4, and electroplating on said first layer a second layer consisting essentially of Cr-containing zinc in a second electrogalvanizing bath with 0.1–10 g/l of $Cr^{3+}$ and/or 0.05–0.5 g/l of $Cr^{6+}$ content.

5. A method as defined in claim 4, wherein said first Zn-Ni alloy plating bath has a pH in the range of 1.5–3.5.

6. A method as defined in claim 4, wherein said first Zn-Ni alloy plating bath has a temperature in the range of 40°–70° C.

7. A method as defined in claim 4, wherein said second electrogalvanizing bath has a pH in the range of 2.5–3.5 when added with a Cr compound of $Cr^{3+}$ and a pH in the range of 3.5–4.5 when added with a Cr compound of $Cr^{6+}$.

8. A method as defined in claim 4, wherein said second electrogalvanizing bath has a temperature in the range of 40°–70° C.

9. A method as defined in claim 4, wherein said first Zn-Ni alloy plating bath has a temperature in the range of 50°–60° C.

10. A method as defined in claim 4, wherein said second electrogalvanizing bath has a temperature in the range of 50°–60° C.

* * * * *